United States Patent [19]

Raheim et al.

[11] Patent Number: 4,743,761

[45] Date of Patent: May 10, 1988

[54] NATURAL TRACER FOR SECONDARY RECOVERY WATER INJECTION PROCESS

[75] Inventors: Arne Raheim, Ski; Philip C. Smalley, Hagan, both of Norway

[73] Assignee: Conoco Inc., Ponca City, Okla.

[21] Appl. No.: 944,287

[22] Filed: Dec. 19, 1986

[51] Int. Cl.[4] ..... G01V 9/02

[52] U.S. Cl. ..... 250/259; 250/256

[58] Field of Search ..... 250/260, 259, 256; 376/167, 160

[56] References Cited

U.S. PATENT DOCUMENTS

| | | | |
|---|---|---|---|
| 3,851,171 | 11/1974 | Saniford et al. | 250/259 |
| 4,178,506 | 12/1979 | Fertl | 250/260 |
| 4,482,806 | 11/1984 | Wagner, Jr. et al. | 250/260 |

OTHER PUBLICATIONS

*Chemical Abstracts,* vol. 51, No. 11203, "Isotopic Composition of Strontium from Seal Water & from Rubidium Pool Rock."

*Chemical Abstracts,* vol. 86, 1977, "Strontium Isotopes in Selected Streams within the Susquehanna River Basin."

*Chemical Abstracts,* vol. 102, 1985, "Means for Monitoring the Results of Sampling Oil and Gas Wells Based on an Analysis of Liquid Samples by Nuclear-Physics Methods."

*Primary Examiner*—Carolyn E. Fields
*Assistant Examiner*—John A. Miller

[57] ABSTRACT

All natural water sources are "labeled" by a unique ratio of strontium isotopes ($^{87}Sr/^{86}Sr$). In accordance with the invention, the strontium isotope ratio for oil bearing formation water and for seawater which is to be injected into the formation is determined. The strontium isotope ratio of the produced water is then monitored at regular intervals and, when the strontium isotope ratio changes to that of the injected water, water injection breakthrough is delimited. The strontium isotope ratio thus serves as a natural tracer for seawater injection.

4 Claims, 1 Drawing Sheet

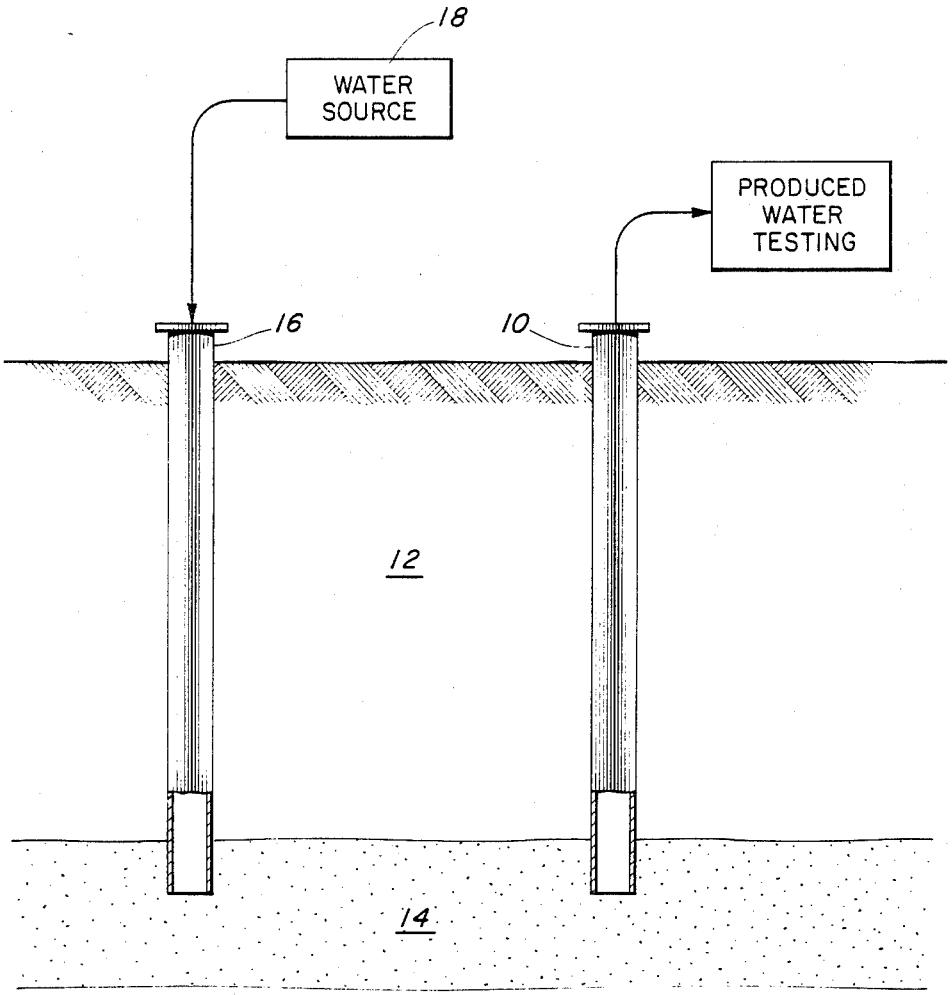
18
WATER SOURCE
PRODUCED WATER TESTING
16
10
12
14

NATURAL TRACER FOR SECONDARY RECOVERY WATER INJECTION PROCESS

This invention relates to the art of secondary oil recovery by water injection and, more particularly, to a process for determining injection water breakthrough in the production wellbore utilizing a natural tracer already present in the injected water.

BACKGROUND OF THE INVENTION

After production of oil reserves from a well which has flowed into the wellbore by natural formation pressures, it is common to employ so-called "secondary recovery" which involves the drilling of at least one injection well remote from the production well and injecting water into the formation through the injection well. Such water injection creates an artificial driving force which displaces additional oil reserves into the production wellbore allowing its recovery.

At some point in the water injection process, injected water breaks through the formation to the well bore and, the effectiveness of such water injection becomes essentially nil. It is therefore desirable to be able to conveniently determine the point at which injection water is produced at the production well due to breakthrough so that such secondary recovery operations can be terminated.

The technique of adding a foreign material as a tracer to injection water and monitoring the produced water for presence of the foreign material tracer is well known in the art. For instance, U.S. Pat. No. 3,851,171, describes a process for tracing injection water in which a water soluble substituted stilbene compound is added to the injection water prior to injection and the produced water is analysed for the presence of the stilbene compound.

Presently used tracers fall into two categories, chemical and radioactive. Chemical tracers such as iodides, nitrates, thiocyanates and alcohols have been used, whereas radioactive tracers include solutions or complexes of radioactive isotopes of hydrogen, carbon, sodium, nickel, strontium and iodine among others. The choice of tracer will depend largely on knowledge of the reservoir and the fluids therein.

Despite the information that may be gained by their use, conventional tracers each have their own problems and limitations. With chemical tracers this can include the cost and inconvenience of transporting and handling literally tons of hazardous materials for each injection well. A limitation common to all conventional tracer methods is that they yield no direct information until they are first detected in the production wells which, in some reservoirs, may be months or even years after injection. Furthermore, with most of these methods, the tracer is added in a batch at the start of the injection process. Detection of a breakthrough is thus totally dependent on all subsequent injected water following the same path as that which contains the tracer—if later injected water somehow "overtakes" the tracer then breakthrough will not be detected.

SUMMARY OF THE INVENTION

The present invention provides a tracer method utilizing a tracer material which is naturally present in injection waters and avoids the handling problems associated with the addition of a foreign substance into the injection water stream.

In accordance with the invention, the natural ratio of strontium isotopes ($^{87}Sr/^{86}Sr$) is determined for the formation water. The natural strontium isotope ratio for the injection water is also determined, such injection water strontium isotope ratio by its nature being different from that of the formation water. The water produced from the production well is then continuously or periodically monitored for the strontium isotope ratio and, a change in the strontium isotope ratio of the produced water to that of the injection water indicates injection water breakthrough to the production well.

It is therefore an object of this invention to provide a process which avoids the use of hazardous foreign tracer materials added to injection water in order to determine injection water breakthrough in a production well.

It is a further object of this invention to provide a simple process for tracing the injection of waters into a hydrocarbon bearing formation while avoiding the use of complex handling, storage and metering equipment used in prior tracer processes.

BRIEF DESCRIPTION OF THE DRAWING

These and other objects of the invention will become apparent through a description of a preferred embodiment of the invention taken in conjunction with the accompanying Drawing forming a part of this specification and in which the sole FIGURE schematically illustrates the injection water tracer process of the present invention.

DETAILED DESCRIPTION OF THE PREFERRED EMBODIMENT AND THE DRAWING

In accordance with the present invention, a natural, radiogenic isotope, strontium 87, is used as a tracer for seawater injection. The method of the present invention involves no addition of costly or hazardous materials to the injected water and, can yield direct information very quickly and can be used in conjunction with conventional injection methods.

$^{87}Sr$ is the daughter product of the natural decay of radioactive Rubidium 87 ($^{87}Rb$) (half-life=48.9 billion years). $^{87}Sr$ abundance is usually expressed relative to that of the stable non-radiogenic isotope $^{86}Sr$, and the $^{87}Sr/^{86}Sr$ ratio can be measured by routine mass spectrometric methods to a precision of $\pm$ approximately 0.00001. For typical seawater or formation water, satisfactory analysis demands no more than a few ml of sample.

Strontium is a relatively abundant trace element in seawater (about 8 ppm). Numerous measurements of $^{87}Sr/^{86}Sr$ in the ocean water have demonstrated that this ratio is constant throughout the World's oceans at about 0.70920 (relative to a value of 0.71025 for the NBS 987 $SrCO_3$ standard). Strontium is supplied to the oceans from various sources, each with characteristic $^{87}Sr/^{86}Sr$ ratios. Strontium with a high $^{87}Sr/^{86}Sr$ ratio ($>0.711$) is supplied from old rocks with high Rb/Sr ratios (e.g., Precambrian granites), and rivers draining, for example, Precambrian bedrock areas reflecting this radiogenic signature. In contrast, strontium derived from weathering of young orogenic areas or from interaction of seawater with oceanic basalts along mid-ocean ridges generally has a low $^{87}Sr/^{86}Sr$ ratio, $<0.705$. A large fraction of Sr in the oceans comes from the weathering of marine carbonate sediments of various ages, which have an $^{87}Sr/^{86}Sr$ close to that of seawater and tend to buffer against any short-term temporal change in seawater as the other Sr supplies vary in importance. Over longer periods, however, significant variation has occurred in the $^{87}Sr/^{86}Sr$ of seawater. The reason why the oceans have similar $^{87}Sr/^{86}Sr$ ratios at any one time, despite the large variations in the isotopic composition of strontium supplied to the oceans in different areas, is that strontium has a long oceanic residence time (about $4\times10^6$ years) compared to the time needed to mix the oceans (about $10^3$ years).

In contrast to seawater, present day oil-field waters have widely variable strontium compositions ($<0.707>0.730$), and strontium contents (about 0–7200 ppm). There are various factors which may have contributed to the present-day $^{87}Sr/^{86}Sr$ of a formation water. Firstly, the original seawater incorporated into the sediment at the time of deposition will vary according to its stratigraphic age. Formation waters may then be modified in situ by water-rock interaction. Processes commonly observed in sandstone reservoirs, such as dissolution of feldspars and micas, will almost always lead to a rise in the $^{87}Sr/^{86}Sr$ of the water. This is because the detrital feldspars and micas usually have high Rb/Sr ratios and, because they are usually old compared to the age of the sedimentary rock in which they were deposited, they have had time to evolve radiogenic ($^{87}Sr$-rich) isotopic compositions. Waters may also equilibrate isotopically with strontium adsorbed onto detrital minerals, especially clays, even in the absence of dissolution. Migration or circulation of water can also lead to modified $^{87}Sr/^{86}Sr$ ratios as the formation water is mixed with, or replaced by, another water which may have a completely different evolutionary history. The infinite number of possible combinations of these parameters can lead to the isotopic heterogeneity of waters within a reservoir, particularly where impermeable barriers are present.

In the vast majority of cases, the $^{87}Sr/^{86}Sr$ of oil-field formation waters is vastly different from that of seawater and it is this which forms the basis of the tracer technique of the present invention. The value of $^{87}Sr/^{86}Sr$ as a tracer for water injection is optimized by first obtaining a reliable picture of the isotopic composition and strontium concentration of the pre-injection water present in the reservoir. This invovles sampling waters at different depth intervals in several wells in the reservoir, allowing a three-dimensional picture of water composition in the reservoir to be built up, which can then be combined with independent knowledge of reservoir anatomy (lithogies, positions of vertical and horizontal permeability barriers etc.) in order to map out different compositional bodies of water (if present) and the features governing their position. This study in itself will yield important information to be used in reservoir evaluation.

Referring now to the drawing, the sole FIGURE shows a production well 10 penetrating the earth 12 to an oil producing formation strata 14. A remote injection well 16 also penetrates the earth's strata 12 to the oil bearing formation 14. The oil bearing formation 14 contains both the desirable oil and formation water which has a characteristic strontium isotope ratio ($^{87}Sr/^{86}Sr$) which has been determined in accordance with the method of the present invention. In order to enhance the recovery of the oil in the oil bearing formation 14, water from a water source 18 is injected into the oil bearing formation 14 through injection well 16. The injected water from the water source 18 drives the fluids including oil and formation water to the production well 10. As these fluids are produced, the produced water is periodically analysed for the strontium isotope ratio characterizing the produced water. Initially, all of the produced water will have the strontium isotope ratio "label" of the original water contained in the oil bearing formation 14. At the point of water breakthrough, that is the point at which injection water has completely penetrated the oil bearing formation 14 between the injection well 16 and the production well 10, the produced water will tend toward a strontium isotope ratio which is characteristic of the injection water from the water source 18 rather than that of the formation water from the oil bearing formation 14.

In accordance with the invention, during the injection stage, the water extracted from the production well 10 is periodically sampled and analysed for strontium isotopic composition and concentration. The analysis is relatively simple and fast, involving use of a thermal ionization mass spectrometer. Strontium concentrations may be precisely measured concurrently by mass spectrometric isotope dilution or alternatively by standard atomic absorption or inductively coupled plasma spectrometric techniques.

Injection water breakthrough can be recognized as soon as there is a measurable tendency of $^{87}Sr/^{86}Sr$ from that of the formation water towards that of seawater. The proportion of seawater that needs to be present in order to distinguish this is dependent on several parameters:

a. the concentration of Sr in the formation water b. the difference between the $^{87}Sr/^{86}Sr$ of the formation water and seawater (0.70920)

c. the constancy of the "base line" value for the formation water

Base line constancy is governed by two factors: random analytical errors and real fluctuations in $^{87}Sr/^{86}Sr$ of produced water caused by minor reservoir inhomogeneities. Analytical uncertainties are of the order of $1\times10^{-5}$ with modern mass spectrometric techniques.

Under optimal conditions of low strontium concentration, high isotope ratio and stable baseline very early breakthrough recognition (about 0.1% seawater) is possible, equalling or bettering detection limits for traditional chemical and radioactive tracers. Even where conditions are not optimal, breakthrough detection at 1–10% seawater is possible for a wide range of geological situations making it applicable as the sole tracer in seawater injections. In cases where more than one injection well is used, chemical or radioactive tracers may be employed in addition to fingerprint (strontium isotope ratio) water from each injection well. When combined with other tracer techniques, the $^{87}Sr/^{86}Sr$ method is a powerful back-up: as the strontium is present in all the seawater injected there is no danger of seawater "overtaking" the tracer in the reservoir. In seawater injections where no tracer was used at the start of injection, the strontium isotope "labeling" method of this invention may be the quickest and surest way of checking for breakthrough. While the invention has been described in the more limited aspects of a preferred embodiment thereof, other embodiments have been suggested and still others will occur to those skilled in the art upon a reading and understanding of the foregoing specification. It is intended that all such embodiments be included within the scope of this invention as limited only by the appended claims.

Having thus described our invention, we claim:

1. A process for determining injection water breakthrough in a water injection enhanced oil recovery operation utilizing natural strontium isotope ratios comprising the steps of:

(a) determining the natural strontium isotope ratio for water present in an oil bearing formation;

(b) determining the natural strontium isotope ratio for an injection water source;

(c) injecting water from said injection water source through an injection well into the oil bearing formation to displace oil and water from said formation through a production well;

(d) monitoring the natural strontium isotope ratio of water produced from said oil bearing formation through said production well; and (e) comparing the monitored natural strontium isotope ratio with the known natural strontium isotope ratio for water present in said oil bearing formation and determining a change in the monitored ratio towards the natural strontium isotope ratio of the injection water.

2. A process for determining injection water breakthrough in a water injection enhanced oil recovery operation utilizing natural strontium concentrations comprising the steps of:

(a) determining the natural strontium concentration for water present in an oil bearing formation;

(b) determining the natural strontium concentration for an injection water source;

(c) injecting water from said injection water source through an injection well into the oil bearing formation to displace oil and water from said formation through a production well;

(d) monitoring the natural strontium concentration of water produced from said oil bearing formation through said production well; and (e) comparing the monitored natural strontium concentration with the known natural strontium concentration for water present in said oil bearing formation and determining a change in the monitored concentration towards the natural strontium concentration of the injection water.

3. A process for determining injection water breakthrough in a seawater injection enhanced oil recovery operation utilizing natural strontium isotope ratios comprising the steps of:

(a) determining the natural strontium isotope ratio for formation water present in an oil bearing formation;

(b) determining that the natural strontium isotope ratio for said formation water is different from about 0.70920;

(c) injecting seawater having a natural strontium isotope ratio of about 0.70920 through an injection well into said oil bearing formation to displace formation water and oil from said formation through a production well;

(d) monitoring the natural strontium isotope ratio of water produced through said production well; and (e) comparing the monitored natural strontium isotope ratio with the known natural strontium isotope ratio for water present in said oil bearing formation and determining a change in the monitored ratio towards the natural strontium isotope ratio of said injected seawater.

4. A process for determing injection water breakthrough in a seawater injection enhanced oil recovery operation utilizing natural strontium concentrations and/or natural strontium isotope ratios comprising the steps of:

(a) determining the natural strontium concentration and the natural strontium isotope ratio for formation water present in an oil bearing formation;

(b) determining that the natural strontium concentration of said formation water is different from about 8 ppm and/or that the natural strontium isotope ratio for said formation water is different from about 0.70920;

(c) injecting seawater having a natural strontium concentration of about 8 ppm and a natural strontium isotope ratio of about 0.70920 through an injection well into said oil bearing formation to displace formation water and oil from said formation through a production well;

(d) monitoring the natural strontium concentration and/or the natural strontium isotope ratio of water produced through said production well; and (e) comparing the monitored natural strontium concentration and/or the monitored natural strontium isotope ratio with the natural strontium concentration and/or the natural strontium isotope ratio for water present in said oil bearing formation and determining a change in the monitored concentration and/or ratio towards the natural strontium concentration and/or the natural strontium isotope ratio of the injected seawater.

* * * * *